United States Patent [19]

Bryson

[11] Patent Number: 4,807,871

[45] Date of Patent: Feb. 28, 1989

[54] SIDE KICK MACHINE

[76] Inventor: Eric C. Bryson, 108 Cornell Avenue, Kitchener, Ontario, Canada, N2G 3E4

[21] Appl. No.: 71,856

[22] Filed: Jul. 10, 1987

[51] Int. Cl.[4] ..... A63B 69/00

[52] U.S. Cl. ..... 272/76; 272/118; 272/134

[58] Field of Search ..... 272/134, 118, 76, 77, 272/78, DIG. 4, 144, 143, 900, 116, 117, 901, 125, 132; 273/55 R, 55 A, 55 B; 128/25 R

[56] References Cited

U.S. PATENT DOCUMENTS

| | | | |
|---|---|---|---|
| 1,199,278 | 9/1916 | Koch | 272/76 |
| 3,399,891 | 9/1968 | McCormick et al. | 272/78 |
| 4,322,071 | 3/1982 | Lambert, Jr. et al. | 272/118 |
| 4,462,252 | 7/1984 | Smidt et al. | 272/134 X |
| 4,511,137 | 4/1985 | Jones | 272/134 X |
| 4,621,807 | 11/1986 | Stramer | 272/118 X |

FOREIGN PATENT DOCUMENTS

| | | | |
|---|---|---|---|
| 2163358 | 2/1986 | United Kingdom | 272/134 |

*Primary Examiner*—Richard J. Apley
*Assistant Examiner*—Howard Flaxman
*Attorney, Agent, or Firm*—Daryl W. Schnurr

[57] ABSTRACT

A side kick machine can be used as an exerciser or a simulator for side kicking. The machine has a kicking pad that can be adjusted in height and a handle that can be adjusted in various directions relative to the kicking pad. A stack of weights is used to vary the force required to move the kicking pad. The kicking pad can pivot from a rest position to a pivotal position in a direction away from the handle when subjected to an external force and return automatically to its rest position when the external force is removed.

16 Claims, 3 Drawing Sheets

SIDE KICK MACHINE

BACKGROUND OF THE INVENTION

1. Field of the Invention

This invention relates to a side kick machine that can be used as an exerciser or a simulator for side kicking.

2. Description of the Prior Art

Side kicking is widely used in martial arts, particularly in Tae Kwon Do, karate, Kung Fu and kick boxing. The side kick is used at varying heights for different purposes. Defensively, the side kick often takes the form of a stop kick or a kick thrown into an area from which the opponent is preparing to attack. Of course, the side kick is also used offensively.

The power of a proper side kick can be devastating and sparring matches between two individuals, who are able to use side kicks, are often done on a simulated or reduced force basis. In other words, the side kick is either not landed or is landed with a greatly reduced force. This is also the case in many contests or tournaments where martial arts are used involving side kicking.

Muscles used in the side kick technique position are different from muscles used in other exercises or sports such as jogging or weight lifting. Thus, even though side kicking has been practiced for many years, there are no exercise machines available to properly develop the muscles used in side kicking or to allow a user to realistically practice the art of side kicking with the machine.

SUMMARY OF THE INVENTION

It is an object of the present invention to provide a side kick machine that can be used to exercise or develop muscles used in side kicking and can alternatively be used as a simulator for practicing the art of side kicking.

A side kick machine that can be used as an exerciser or simulator for side kicking has a frame supporting a foot pad that is oriented towards a handle. The handle is supported by said frame horizontally apart from said foot pad. The foot pad has a rest position and is pivotally supported in said frame so that it can be made to pivot about a pivot point from said rest position to a pivotal position in a direction away from said handle when subjected to an appropriate external force and return automatically to its rest position when the external force is removed. The handle and foot pad are located relative to one another and relative to a supporting surface so that a user of the machine can stand on the supporting surface between said foot pad and said handle and can assume a side kick position relative to said foot pad while hanging onto said handle. A kicking surface of said foot pad is substantially normal to a supporting surface when the foot pad is in a rest position and the machine is in an upright position. The foot pad pivots in a vertical plane through said pivot point, a centre of said foot pad and a centre of said handle at all times from said rest position to said pivotal position.

BRIEF DESCRIPTION OF THE DRAWINGS

In drawings which illustrate a preferred embodiment of the invention.

DESCRIPTION OF A PREFERRED EMBODIMENT

Figure 1:
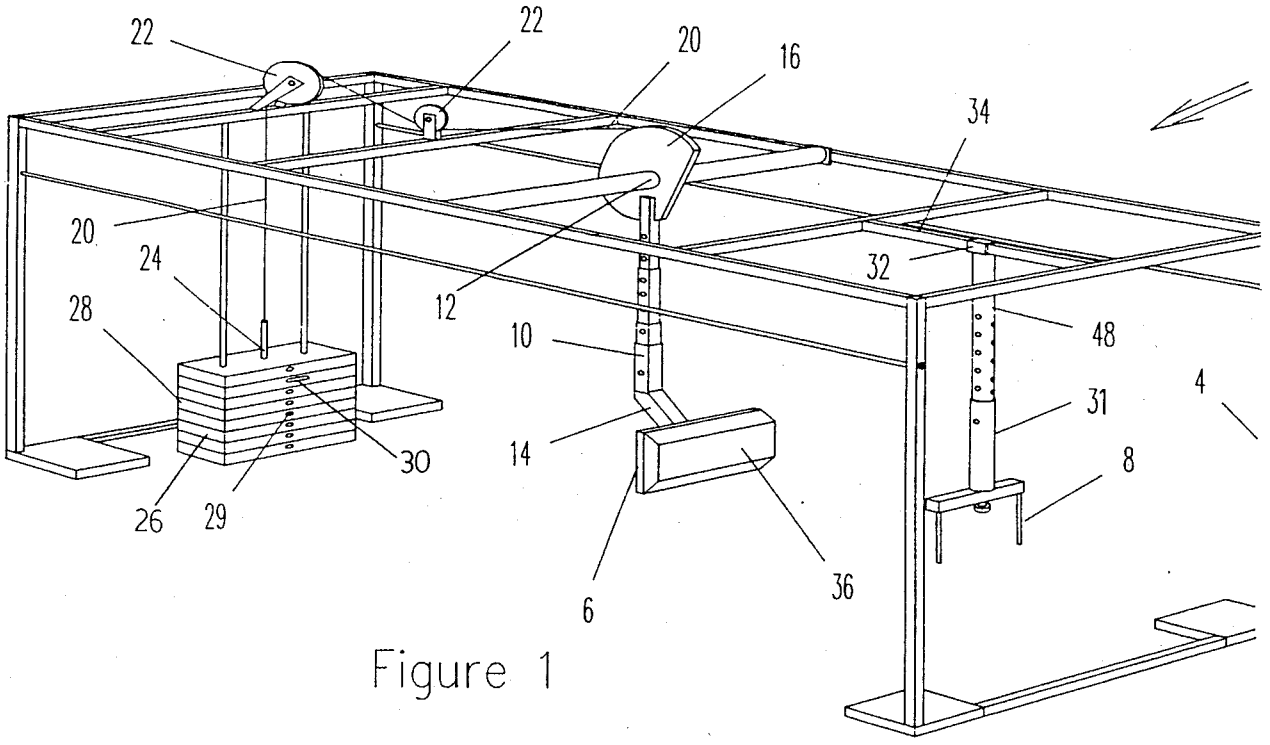
FIG. 1 is a perspective view of a side kick machine.

In FIG. 1, it can be seen that a side kick machine 2 has a frame 4 supporting a foot pad 6 that is oriented toward a handle 8 located adjacent thereto. The foot pad 6 is shown in a rest position and is pivotally supported in said frame 4 by an arm 10. The arm 10 extends vertically downward from a pivot point 12. A lowermost section 14 of the arm 10 extends towards said handle 8. In this way, the foot pad 6 is mounted relative to the pivot point 12 so that the initial movement of the foot pad from a rest position is slightly downward. A cam 16 extends radially outward from the pivot point 12. The cam 16 has a leading edge 18 and a cable 20 is attached to said leading edge and through pulleys 22 to a rod 24. The cam 16 has a radius that decreases slightly from said leading edge 18 so that the initial force required to move the foot pad is small compared to the number of weights being moved, the force increasing steadily as a leg of the user is extended.

The rod 24 extends through a stack 26 of weights 28. Each weight 28 has an opening in its centre that is large enough to receive the rod 24. The rod 24 and weight stack 26 is conventional. The rod 24 has a series of openings therein and a channel 29 is formed in each weight 28 to receive a pin 30 which can extend through the channel into an opening of the rod 24. In this manner, by moving the pin upward or downward in the weight stack, a smaller number or a greater number of weights respectively can be lifted when a sufficient force is exerted on the cable 20.

The handle 8 is connected by a shaft 31 to a cylindrical base 32. The cylindrical base is slidably mounted on a horizontal pipe 34 that is normal to a kicking surface 36 of the foot pad 6. The part 34 extends near said pivot point.

Figure 2:
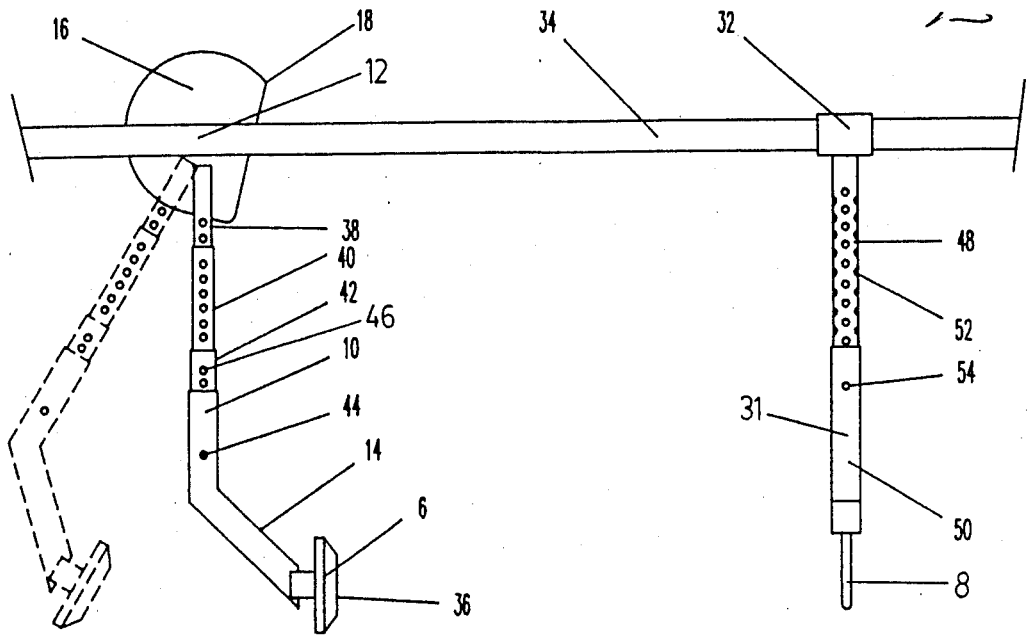
FIG. 2 is a partial side view of the machine of FIG. 1 showing the foot pad and handle.
Figure 3:
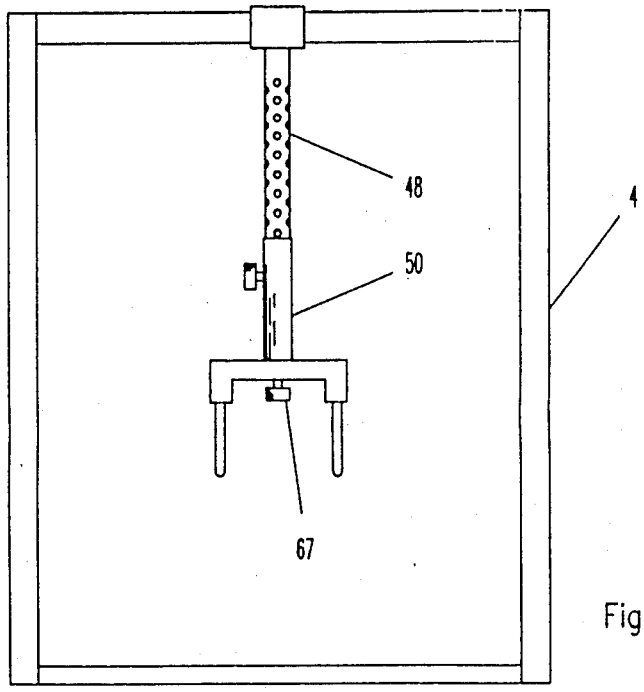
FIG. 3 is an end view of the handle.

In FIG. 2, it can be seen that the arm 10 supporting the foot pad 6 has four telescopic sections 38, 40, 42 and 14. Each of the sections has a series of openings 46 therein so that a pin 44 can be inserted into two or more aligned openings, one from each section, when it is desired to adjust the foot pad vertically. As can be seen, as the foot pad is adjusted to a high position, the sections will completely overlap with one another and the pin will be inserted through four openings, one from each section.

Similarly, the handle 8 is also adjustable as the shaft 31 is divided into two sections 48, 50. The sections have a series of openings 52 therein so that a pin 54 can be inserted into two or more aligned openings, one from each section, to hold the handle in a fixed position.

Also, the interior section 48 has three openings at each horizontal level, said openings being located 45° apart from one another. This allows the handle to be turned relative to the kicking surface 36, either to the right or to the left.

The kicking pad 6 and arm 10 are shown in FIG. 2 with solid lines in a rest position and with dotted lines in a pivotal position. It should be noted that the horizontal level of the foot pad 6 in the two positions shown is essentially the same. For clarity of illustration, the cam 16 is shown in the rest position only.

As can be seen from FIGS. 2, 3, 5 and 6, the pipe 34 has a square cross-section and a series of openings 54 along its length. The base 32 has a corresponding square cross-section to prevent the base 32 from rotating relative to the pipe 34. A pin 60 is mounted by a spring within a casing 64. The pin 60 is remotely controlled at the handle 8 by a telescoping rod 66. The rod 66 has a handle 67 at a lower end thereof. The handle 67 and rod 66 are located at a centre of the handle 8. As the handle 8 is adjusted upward, the rod 66 will become smaller as the sections overlap with one another. As the handle is lower, the rod 66 will become longer. Whether the handle is adjusted to a high position or low position, the rod 66 will have to be fully extended in order to remove the pin 60 from one of the openings 54. When that is done, the base 32 can be slid to a convenient location along the pipe 34 relative to the foot pad 6.

Figure 4:
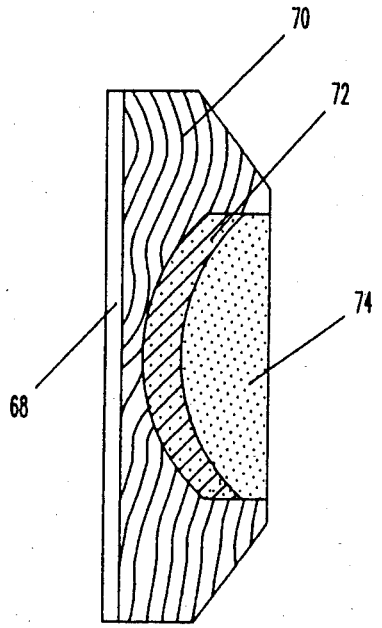
FIG. 4 is a sectional side view of the foot pad.
Figure 5:
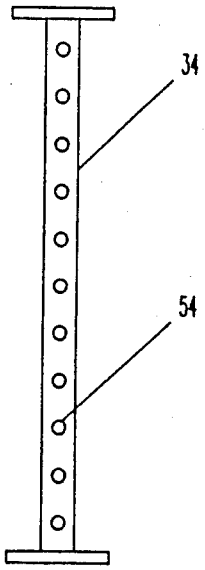
FIG. 5 is a bottom view of a pipe that supports the handle.
Figure 6:
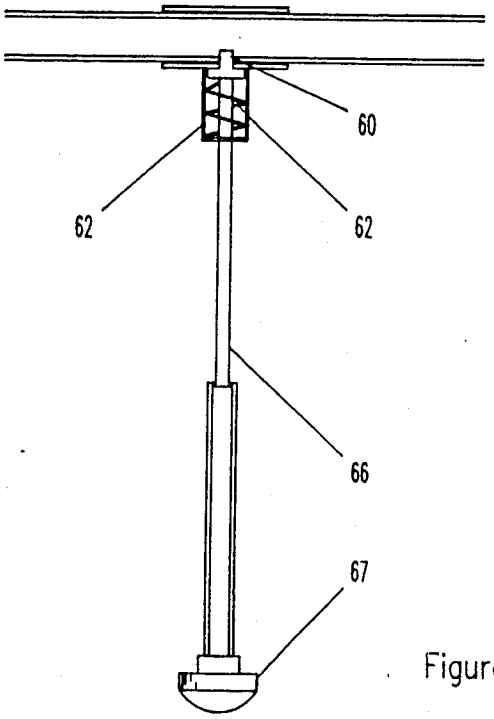
FIG. 6 is a side view of a removable pin interconnecting the handle and pipe, with a shaft removed.

In FIG. 4, it can be seen that the foot pad has a metal backing plate 68, supporting a hardwood frame 70. The hardwood frame of, for example, maple, has an elongated channel therein, an inner portion of the channel being lined with hard foam 72 and an outer portion of the channel being lined with soft foam 74. A cover 76 of leather, Naugahyde (a trade mark) or other suitable material holds the foam in place on the hardwood. The channel is long enough and wide enough to receive a foot of a user. Numerous variations in the shape or type or components used to construct the foot pad will be readily apparent to those skilled in the art.

While the adjustment means for the handle and foot pad are described in some detail, numerous other types of adjustment means will be readily apparent to those skilled in the art. For example, the horizontal adjustment of the handle through the rod 66 and pin 60 could be varied so that a spring-mounted pin is located outside of the shaft 30. It is important that the foot pad be adjustable vertically and that the handle be adjustable both vertically and horizontally relative to the foot pad. Short users will often wish to lower the foot pad and tall users will often wish to raise the foot pad. Also, individual users will want to lower the foot pad for part of their exercise period and raise it for another part of the exercise period in order to practice kicks or exercise side kick muscles for kicks are various levels. When the foot pad is raised or lowered, the handle 8 will usually be moved in an opposite direction (that is, when the foot pad is lowered, the handle will usually be raised and vice versa). The radius of the cam 16 decreases slightly from a leading edge 18 so that the foot pad becomes more difficult to pivot as the leg of a user is further extended.

The machine 2 can be used to exercise and/or develop muscles of a user in side kicking and can be used to exercise both legs, one at a time. In operation, a user will adjust the foot pad vertically to a desired position and ensure that the pin 29 is located properly to lift the desired number of weights. Next, a user will adjust the handle vertically and horizontally so that the handle is close to the foot pad and can be conveniently held by the user when a foot of the user is placed on the foot pad and the leg of the user is bent at the knee and thigh. The user may wish to orient the handle at a 45° angle to the kicking surface of the foot pad. For left leg exercise, the user will typically rotate the handle 45° counterclockwise from its usual position parallel to the kicking surface. For right leg exercise, the user will typically rotate the handle 45° clockwise from its usual position. The user will then extend his leg fully, thereby causing the foot pad to pivot away from the handle and then relax his leg so that the foot pad will return to a rest position as shown in FIGS. 1 and 2. The user will then continue to extend and relax his leg for a desired time interval. Thus, the machine can be used to exercise the legs of a user, one at a time, to develop and strengthen those muscles that are used for side kicking.

Alternatively, the user can use the machine as a simulator for side kicking and actually practice kicking the foot pad in a side kicking manner. In this position, the handle 8 will be moved further away from the foot pad than it was for the exercise position. The user will adjust the foot pad vertically and the handle vertically and horizontally. The user may wish to orient the handle to a comfortable position depending on which leg the user intends to use for kicking the foot pad. The user will adjust the pin 29 for the weight stack 26 to ensure that a desired number of weights will be lifted as the handle is pivoted. Some users will want to use all of the weights so that the foot pad will not pivot at all. Thus the machine can be used as a side kick simulator. As the practice session proceeds the user may wish to change the position of the foot pad and/or handle or make adjustments to the weights. The method of using the machine will vary with the individual desires and objectives of users.

It should be noted that the actual machine 2 is taller than that shown in FIG. 1. The legs of the frame 4 are long enough to allow a user to fit comfortably beneath the top of the frame 4 in a standing position. The legs shown in FIG. 1 are drawn shorter than normal for ease of illustration.

What I claim as my invention is:

1. A side kick machine that can be used as an exerciser or a simulator for side kicking, said machine comprising a frame supporting a foot pad that is oriented towards a handle, said handle being supported by said frame horizontally apart from said foot pad, said foot pad having a rest position and being pivotally supported on said frame so that it can be made to pivot about a pivot point from said rest position to a pivotal position in a direction away from said handle when subjected to an appropriate external force and return automatically to its rest position when the external force is removed, said handle and foot pad being located relative to one another and relative to a supporting surface so that a user of the machine can stand on the supporting surface between said foot pad and said handle and can assume a side kick position relative to said foot pad while hanging onto said handle, a kicking surface of said foot pad being substantially normal to a supporting surface when the foot pad is in the rest position and the machine is in an upright position, said foot pad pivoting in a vertical plane through said pivot point, a centre of said foot pad and a centre of said handle at all times from said rest position to said pivotal position.

2. A side kick machine as claimed in claim 1 wherein the foot pad is adjustable vertically relative to the supporting surface.

3. A side kick machine as claimed in claim 2 wherein the handle is adjustable vertically and horizontally relative to the foot pad.

4. A side kick machine as claimed in any one of claims 1, 2 or 3 wherein the foot pad is mounted relative to the pivot point so that the initial movement of the foot pad from a rest position is slightly downward.

5. A side kick machine as claimed in claim 3 wherein there are a stack of weights connected by a cable through pulleys to the pivot point so that the external force required to pivot the foot pad varies with a counterforce created by the weights, the number of weights exerting the counterforce being adjustable.

6. A side kick machine as claimed in claim 5 wherein there is a cam extending radially outward from the pivot point and the cable attached to the weights extends from a leading edge of a periphery of the cam, a radius of the cam decreasing slightly from said leading edge so that the initial force required to move the foot pad is small compared to the number of weights being moved, said force increasing steadily as a leg of a user is extended.

7. A side kick machine as claimed in claim 2 wherein an arm extends between the pivot point and the foot pad.

8. A side kick machine as claimed in claim 7 wherein the arm has at least two concentric sections with a series of openings therein and a pin that can be inserted into two or more openings, one from each section, that are aligned with one another.

9. A side kick machine as claimed in any one of claims 2, 3 or 8 wherein the arm extends vertically downward from the pivot point to the foot pad and a lowermost section of said arm extends toward said handle.

10. A side kick machine that can be used as an exerciser or simulator for side kicking, said machine comprising a frame supporting a foot pad that is oriented towards a handle located adjacent thereto, said foot pad having a rest position and being pivotally supported on said frame so that it can be made to pivot about a pivot point from said rest position to a pivotal position in a direction away from said handle when subjected to an appropriate external force and return automatically to its rest position when the external force is removed, said handle and foot pad being located relative to one another and relative to a supporting surface so that a user of the machine can assume a side kick position relative to said foot pad while hanging onto said handle, a kicking surface of said foot pad being substantially normal to a supporting surface when the foot pad is in the rest position and the machine is in an upright position, said foot pad being adjustable vertically relative to said supporting surface, said handle being adjustable vertically and horizontally relative to said foot pad, said handle being connected by a shaft with at least two telescoping sections to a cylindrical base, the sections having a series of openings therein with a pin that can be inserted into two or more aligned openings, one from each section, to hold the handle in a fixed position, the cylindrical base also having an opening therein where the shaft is connected to said base, said cylindrical base being slidably mounted on a horizontal pipe that is normal to a kicking surface of said foot pad, said pipe having a series of openings therein with a spring-mounted pin, remotely controlled at said handle, said pin being capable of being inserted into two aligned openings of said base and pipe to adjust the handle horizontally relative to the foot pad.

11. A side kick machine as claimed in claim 10 wherein the pipe is mounted along a top of said frame.

12. A side kick machine as claimed in claim 11 wherein the pipe extends near said pivot point.

13. A side kick machine as claimed in claim 11 wherein there are means to prevent the base from rotating relative to said pipe.

14. A side kick machine as claimed in claim 13 wherein the means for preventing the base from rotating relative to said pipe is a groove in said pipe with a corresponding inward projection in said base that is slidably mounted within said groove.

15. A side kick machine as claimed in claim 10 wherein interior sections of said shaft have three openings at each level, said three openings being spaced laterally from one another so that the handle can be oriented diagonally relative to said foot pad when the pin is inserted into aligned openings.

16. A side kick machine as claimed in claim 15 wherein the three openings at each level are spaced laterally substantially 45° from one another.

* * * * *